US006358103B1

(12) United States Patent
Tomasino

(10) Patent No.: US 6,358,103 B1
(45) Date of Patent: Mar. 19, 2002

(54) NO-CRIMP ELECTRICAL CONNECTOR SIDE-BY-SIDE TYPE

(75) Inventor: René Tomasino, Doniphan, MO (US)

(73) Assignee: Swenco Products, Inc., Polar Bluff, MO (US)

( * ) Notice: Subject to any disclaimer, the term of this patent is extended or adjusted under 35 U.S.C. 154(b) by 0 days.

(21) Appl. No.: 09/617,231

(22) Filed: Jul. 14, 2000

Related U.S. Application Data

(60) Provisional application No. 60/146,344, filed on Aug. 2, 1999.

(51) Int. Cl.[7] ..... H01R 11/03
(52) U.S. Cl. ..... 439/791
(58) Field of Search ..... 439/791, 784, 439/805, 845; 219/541; 350/96.2; 285/334.4; 24/136 B

(56) References Cited

U.S. PATENT DOCUMENTS

| | | | | |
|---|---|---|---|---|
| 939,501 A | | 11/1909 | Hinds | |
| 1,751,572 A | | 3/1930 | Beemer | |
| 1,941,715 A | | 1/1934 | Pfisterer | 173/303 |
| 2,001,131 A | | 5/1935 | Guhl | 173/268 |
| 2,064,440 A | | 12/1936 | Meeker | 173/303 |
| 2,069,090 A | | 1/1937 | Hawkinson | 18/59 |
| 3,079,459 A | | 2/1963 | Abbott | 174/91 |
| 3,628,815 A | * | 12/1971 | King | 285/334.4 |
| 3,786,173 A | | 1/1974 | Vogt | 174/88 |
| 4,070,543 A | | 1/1978 | Thompson et al. | 174/87 |
| 4,204,739 A | | 5/1980 | Shoenleben | 339/75 R |
| 4,720,275 A | | 1/1988 | Swart et al. | 439/725 |
| 4,773,725 A | * | 9/1988 | Ashman et al. | 350/96.2 |
| 4,874,909 A | | 10/1989 | Velke, Sr. et al. | 174/845 |
| 5,228,875 A | | 7/1993 | Swenson, Sr. | 439/784 |
| 5,502,280 A | | 3/1996 | Rocci et al. | 174/84 R |
| 5,542,861 A | | 8/1996 | Anhalt et al. | 439/578 |
| 5,695,369 A | * | 12/1997 | Swenson, Sr. | 439/784 |
| 5,756,972 A | * | 5/1998 | Vranicar et al. | 219/541 |

* cited by examiner

*Primary Examiner*—Gary Paumen
*Assistant Examiner*—PhuongChi Nguyen
(74) *Attorney, Agent, or Firm*—Jim Zegeer

(57) ABSTRACT

A no-crimp electrical connector which does not require any metal pieces and is essentially comprised of two molded plastic body members. A molded plastic first body member has a connection chamber and a threaded wall bounds the connection chamber. A second molded plastic second body member has an externally threaded surface threadably engageable with the threaded wall in the first body member. One of the body members has an integral central conically shaped element which has an axis coaxial with the body member in which it is formed. The second body member has a throughbore with the throughbore having first and second ends. The first throughbore end is shaped to accommodate two or more wires in parallel, side-by-side relation. Preferably, the shape is oval or oblong. The second end of the throughbore has conical walls which are complementary to the conical shape of the integral central conical element so that the wire ends of the two or more wires are clamped together between the integral central conical shaped element and the conical surface when the threadably engaged surfaces are rotated relative to each other to move the integral central conical shaped element and the conical surfaces towards each other, respectively.

11 Claims, 2 Drawing Sheets

NO-CRIMP ELECTRICAL CONNECTOR SIDE-BY-SIDE TYPE

REFERENCE TO RELATED APPLICATION

The present application is based on provisional application No. 60/146,344 filed Aug. 2, 1999 entitled NO-CRIMP ELECTRICAL CONNECTOR SIDE-BY-SIDE TYPE.

BACKGROUND AND BRIEF DESCRIPTION OF THE INVENTION

This invention is an improvement on the QUICK MULTIPLE ELECTRICAL CONNECTOR disclosed in Swenson Patent No. 5,695,369 and Swenson Patent No. 5,228,875. In the above-referenced Swenson patents, one or more connection chambers has mounted therein a shaped surface projecting into the connection chamber and a threaded surface associated therewith. A coacting clamping member is associated with the connection chamber and each clamping member has a threaded portion which is threadably engageable with the threaded surface of the connection chamber and has a complementary tapered surface which is complementary to the tapered surface on the conductive member. Stranded conductive wires are passed through the hollow clamping member and splayed on the conical or taper-shaped surface of the metal conductor. The relative rotation between the housing member and the clamping member causes the threads to reduce the distance and clamp the bare ends of the splayed wire between the conical surfaces.

The present invention does not require any metal pieces and is essentially comprised of two molded plastic body members. A molded plastic first body member having a connection chamber and a threaded wall bounding the connection chamber. A second molded plastic second body member having an externally threaded surface threadably engageable with the threaded wall in the first body member. One of the body members has an integral central conically shaped element having an axis coaxial with the body member in which it is formed. The second body member has a throughbore with the throughbore having first and second ends. The first throughbore end is shaped to accommodate two or more wires in parallel, side-by-side relation. Preferably, the shape is oval or oblong. The second end of the throughbore has conical walls which are complementary to the conical shape of the integral central conical element so that the wire ends of the two or more wires are clamped together between the integral central conical shaped element and the conical surface when the threadably engaged surfaces are rotated relative to each other to move the integral central conical shaped element and the conical surfaces towards each other, respectively.

Thus, an object of the invention is to provide an improved no-crimp electrical connector for connecting stranded electrical wires to each other. Lower gauge solid wires may also be connected using the invention.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
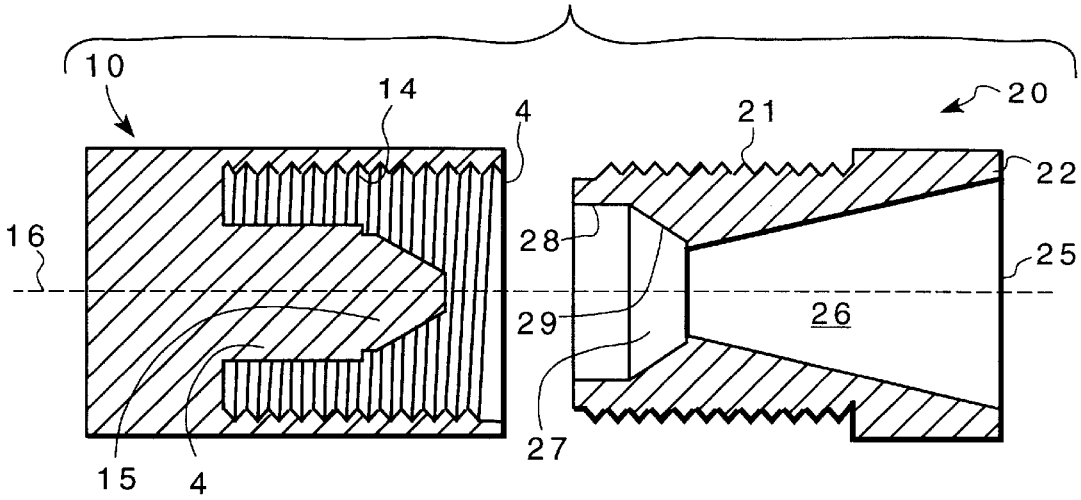
FIG. 1 is a sectional view of a no-crimp connector incorporating the invention.
Figure 2:
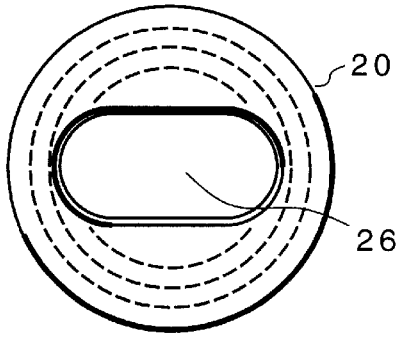
FIG. 2 is an end view of the connector shown in FIG. 1.
Figure 3:
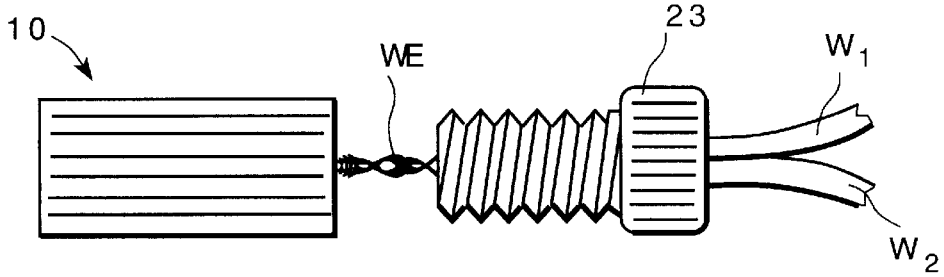
FIG. 3 is a side elevation view showing the connector of FIG. 1 with two wires being connected together, the two wires are then stripped and twisted together before inserting into a male end.

Referring to FIG. 1, a female body member 10 has a connection chamber 11 with an internally threaded wall 14 bounding the connection chamber 11. Female body member 10 is of molded plastic and has a central conical shaped element or projection 15 having an axis 16 coaxial with the female body member 10. Shank 14 positions or spaces the conical shaped element in chamber 11. A male body member 20 has an externally threaded surface 21 and a grasping portion 22 which may be knurled as at 23 (FIG. 3). The male member 20 has a throughbore 25 with first and second ends 26, 27. Throughbore end 26 is preferably oval shaped as shown in the end view of FIG. 2 and is adapted to receive two or more wires as shown in FIG. 3 with the ends WE twisted together as indicated is FIG. 3.

Throughbore end 27 has a short straight section 28 and a conical surface section 29 which is complementary shaped to the conical shape on end 15 of central projection shank 14.

In operation, two or more insulated wires W1, W2 . . . WN have their ends stripped of insulation and then twisted together as indicated at WE and inserted through the throughbore end 26. Conical end 15 serves as a splaying surface. The threaded portion 14 of the female member 10 may be threadably engaged with externally threaded portions of the male member 20 before or after insertion of the twisted wire ends WE. The twisted wire ends enter or are splayed into a space between the conical surface 15 and conical surface 29 and, as the threaded members are twisted relative to each other (by thumb and forefinger), the surface 29 and conical surface 15 move toward each other to thereby clamp together the wire ends WE of the two or more wires to maintain a tight electrical contact and to prevent them from being pulled apart. One or both conical surfaces may have ribs to deform the wire and enhance the pull strength.

Figure 4:
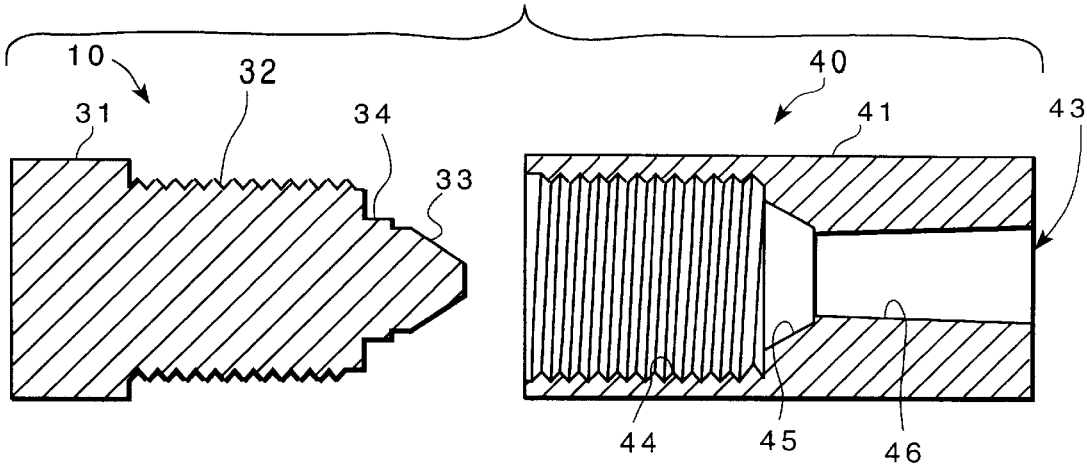
FIG. 4 is a sectional view of a further embodiment of the invention.
Figure 5:
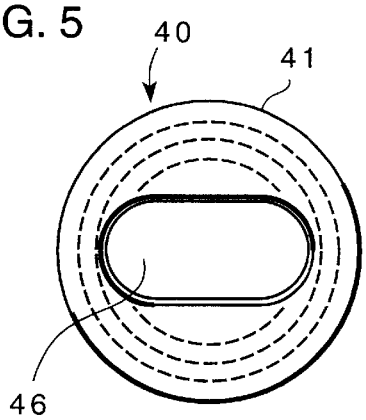
FIG. 5 is an end view of the embodiment shown in FIG. 4.
Figure 6:
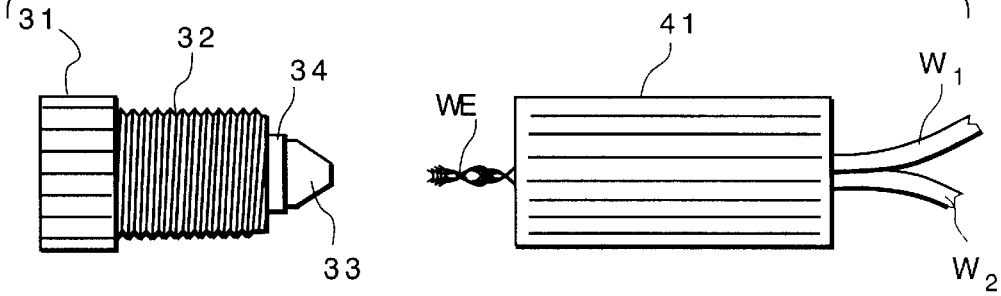
FIG. 6 is a side elevational view of the embodiment of FIG. 4 for joining two or more wires which have been stripped and twisted together before entering into the female end.

In the embodiment shown in FIG. 4, the male body member 30 with a gripping portion 31, which is knurled or roughened (or provided with wingnuts like projections) to prevent slippage in the finger, see FIG. 6, and an externally threaded portion 32 leading to a conically or bullet-shaped protuberance 33 which serves as a splaying surface and has a circular base 34. Female body member 40 has an externally knurled surface 41 and a throughbore 42. Throughbore bore 42 has three sections:

A threaded internal wall section 44 which is threadably engageable with threaded section 32 on male member 30,

- a conical shaped section 45 which is complementary to conical or bullet-shaped member 33 and serves to define a wire clamping space therebetween, and
- an oval-shaped section 46 for receiving two or more wires W1, W2 which has an end stripped to expose bare wire ends WE which have been twisted together and inserted in the throughbore 43 via the oval end 46.

In use, the wires W1, W2 with their twisted ends WE may be inserted into the female member 40 prior to or after threaded engagement of the male member threads 32 with the female member threads 44 or they may be inserted after the threaded engagement of male member threads 32 with female member threads 44. At any rate, a space is formed between conical surfaces 33 and 45 into which the conical end 33 is splayed to one side. Relative rotation between the male and female body members causes a strong clamping of the wire ends between the conical surfaces 33 and 45.

While the invention has been described in relation to preferred embodiments of the invention, it will be appreciated that other embodiments, adaptations and modifications of the invention will be apparent to those skilled in the art.

What is claimed is:

1. A no-crimp electrical connector of the side-by-side type wherein the bare ends of two or more wires are connected without tools comprising:

a non-conductive female body member having a connection chamber and a threaded wall bounding said connection chamber, a non-conductive male body member having an externally threaded surface threadably engageable with the threaded wall on the female body member, one of said body members having a non-conductive conically shaped element formed integral therewith, the other of said body members having a throughbore, said throughbore having first and second ends, said first end being sized to accommodate two or more wires in side-by-side relation, said second end having a conical wall which is complementary in shape to the conical shape of said conically shaped element, whereby connection of said two or more wires can be made by stripping said wire ends of insulation and twisting said wire ends together, inserting said twisted wire ends in said first end of said throughbore and rotating threadably engaged first and second body together so that said two or more wire ends are clamped together between said conical surface on said conically shaped element and said conical surface on said throughbore.

2. A two-part, no-crimp electrical connector for connecting the bare ends of two or more side-by-side insulated wires together comprising:

a molded plastic first body member having a connection chamber and a threaded wall bounding said connection chamber, said first body member having an integrally formed central conically shaped element having an axis coaxial with the connection chamber, a second molded plastic body member having an externally threaded surface threadably engageable with said threaded wall and said first body member, said second body member having a throughbore with the throughbore having first and second ends, the first of said ends being sized to accommodate two or more wires in side-by-side relation, and a second end of said throughbore having a conical wall which is complementary to the conical shape of the conically shaped element so that the bare ends of the two or more insulated wires are locked together between the central conically shaped element and the conical wall when the threadably engaged surfaces are rotated relative to each other to move the central conically shaped element and the conical surfaces toward each other, respectively.

3. A two-part, no-crimp electrical connector for connecting the bare ends of two or more wires together side-by-side comprising:

a molded cup-shaped plastic first body member having a connection chamber and a threaded wall bounding said connection chamber and a central conically shaped element having an axis coaxial with said connection chamber and formed integral with said first body member, a second molded plastic body member having an externally threaded surface threadably engageable with said threaded wall in said first body member, said second body member having a throughbore, said throughbore having first and second ends, said the first of said ends being shaped to accommodate two or more wires in parallel side-by-side relation, and a second end of said throughbore having conical walls which are complementary to the conical shape of said central conical element so that the wire ends of the two or more wires are clamped together when threadably engaged surfaces are rotated relative to each other to move the central conically shaped element and the conical surface toward each other, respectively, with said bare ends therebetween.

4. A two-part, no-crimp electrical connector for connecting two or more wires having bare ends together in side-by-side relation, comprising:

a cup-shaped, non-conductive female body member having a connection chamber and a threaded wall bounding said connection chamber, and a conically shaped element formed integral with said cup-shaped female body member and coaxial with said connection chamber, a non-conductive male body member having an externally threaded surface threadably engageable with the threaded wall on the said female body member and having a throughbore with first and second ends, said first end being sized to accommodate said two or more wires in side-by-side relation and said second end having a conical wall which is complementary to the conical shape of said conically shaped element.

5. A wire connector for connecting the ends of two or more wires together without tools, comprising:

a non-conductive female body member, said female body member having a connection chamber and a threaded wall bounding said connection chamber, a non-conductive male body member having an externally threaded surface threadably engageable with said threaded wall on said female body member, one of said body members having integrally formed therewith a non-conductive conically shaped element having an axis coaxial with said one of said body members, the other one of said body members having a throughbore with first and second ends, said first end being sized to accommodate said two or more wires in side-by-side relation, said second end having a conical wall which is complementary to the conical shape of said conically shaped element so that said wire ends of said two or more wires are clamped together in electrical contact between said conically shaped element and said conical wall when the threadably engaged surfaces are rotated relative to each other to move said conical shaped element and said conical wall towards each other, respectively.

6. The wire connector defined in claim 5 wherein said one of said body members is said female body member and said other one of said body members is said male body member.

7. The wire connector defined in claim 5 wherein said one of said body members is said male body member and said other one of said body members is said female body member.

8. The wire connector defined in claim 5 wherein said first end is oval shaped.

9. The method of connecting the ends of two or more insulated wires together without tools comprising:

providing a non-conductive female body member having a connection chamber and a threaded wall bounding said connection chamber, a non-conductive male body member having an externally threaded surface threadably engageable with the threaded wall on the female body member, one of said body members having integrally formed therewith a non-conductive element with a conically shaped surface, the other of said body members having a throughbore with first and second ends, said first end being sized to accommodate two or more wires in side-by-side relationship, said second end having a conical wall surface which is complementary to the conical shape of said conically shaped surface, stripping the wire ends and twisting said wire ends together, inserting said twisted-together wire ends in said first end of said throughbore, twisting said threadably engaged first and second body members together so that said two or more wire ends are clamped together and electrical contact between said conically shaped element and said conical surface when said threadably engaged surfaces are rotated relative to each other to move said conically shaped element and said conical surfaces toward each other, respectively.

10. The method defined in claim 9 wherein said wires are of the same wire gauge size.

11. The method defined in claim 9 wherein said wires are stranded wires.

* * * * *